US006223401B1

(12) United States Patent
D'Sa et al.

(10) Patent No.: US 6,223,401 B1
(45) **Date of Patent: *May 1, 2001**

(54) INTERMESHABLE ARTICLES

(75) Inventors: Joseph M. D'Sa, Woodbury; Paul E. Humpal, Stillwater; Raymond P. Johnston, Lake Elmo; Vincent W. King, Woodbury, all of MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,830

(22) Filed: Oct. 1, 1998

(51) Int. Cl.[7] ..... A44B 18/00; A44B 17/00

(52) U.S. Cl. ..... 24/444; 24/452; 24/442; 24/575

(58) Field of Search ..... 24/306, 442–452, 24/575–578; 248/205.2; 156/66

(56) References Cited

U.S. PATENT DOCUMENTS

| | | | | |
|---|---|---|---|---|
| 4,290,174 | * | 9/1981 | Kalleberg | 24/444 |
| 4,875,259 | | 10/1989 | Appeldorn . | |
| 5,088,164 | * | 2/1992 | Wilson et al. | 24/576 |
| 5,103,546 | | 4/1992 | Rossini et al. . | |
| 5,201,101 | | 4/1993 | Rouser et al. . | |
| 5,203,053 | * | 4/1993 | Rudd | 24/306 |
| 5,316,849 | * | 5/1994 | Lu et al. | 24/575 X |
| 5,344,177 | | 9/1994 | Rouser et al. . | |
| 5,360,270 | | 11/1994 | Appeldorn et al. . | |
| 5,634,245 | * | 6/1997 | Rouse et al. | 24/452 |
| 5,638,581 | * | 6/1997 | Burke | 24/306 X |
| 5,657,516 | | 8/1997 | Berg et al. . | |

FOREIGN PATENT DOCUMENTS

WO 99/32005 7/1999 (WO) .

* cited by examiner

*Primary Examiner*—James R. Brittain
*Assistant Examiner*—Robert J. Sandy
(74) *Attorney, Agent, or Firm*—William L. Huebsch

(57) ABSTRACT

An article includes a mating surface fastener portion attached to a surface. The mating surface fastener portion has a land and a plurality of tapered elements and is capable of reattachably and matingly intermeshing with a fastener portion of another article to fasten the respective articles. The fastener portions have a predetermined disengagement pressure for a given engagement pressure. The surface to which the land is attached is at least semi-rigid. The means for attaching has a compliance that is no greater than 0.381 cm. Also, the fastener portions can have a predetermined disengagement pressure for a given engagement pressure; for an engagement pressure of no more than 689,500 N/m$^2$ the fastener portion has a disengagement pressure of at least 137,900 N/M$^2$.

17 Claims, 3 Drawing Sheets

INTERMESHABLE ARTICLES

TECHNICAL FIELD

The present invention relates to mechanical fasteners. More particularly, the present invention relates to mating surface fasteners.

BACKGROUND OF THE INVENTION

Fastening technologies span a very wide range of methods and materials. Screws, bolts, and rivets are high strength fasteners that focus the stress of separation into concentrated locations. They use relatively high tensile strength materials, and focus the forces of attachment at the points where the fastening is used. Mechanical fasteners, such as hook and loop fasteners and headed stem fasteners, rely on a mechanical interference to attain coupling.

Adhesives (such as pressure sensitive adhesives), glues, and epoxies distribute adhesion forces, but are not refastenable in high strength applications. In many cases they require curing or adhesion dwelling before the ultimate fastening strength is achieved. Generally there is an unmet need for instant high strength fastening, with refastenability where the forces are distributed over a large area. There is also a need to accomplish this using a low profile or thin layer.

Mating surface fasteners are a type of self-mating fasteners. They use intermeshable articles, some of which require alignment before pressing the structured surfaces together (U.S. Pat. No. 4,875,259) and some of which can be fastened in random alignment (U.S. Pat. No. 5,201,101). Other mating surface fasteners are disclosed in U.S. Pat. Nos. 5,344,177 and 5,360,270. Mating surface fasteners do not require a mechanical interference. They use a frictional interaction between adjacent elements.

Mating surface fasteners typically include a series of structured surfaces, such as tapered elements or posts, connected to a sheet, sometimes called a base or land. Two articles can be removably attached to each other by first attaching a mating surface fastener to each article. This is typically performed using an adhesive.

Each tapered element has at least one side inclined relative to a common plane at an angle sufficient to form a taper. The sheets' plurality of tapered elements are situated to form a plurality of axes including at least one longitudinal axis on each sheet. When fastened together, the longitudinal axis of each sheet is at an angle relative to the longitudinal axis of the other sheet. Also, at least one of the tapered elements is axially bent or torsionally flexed or twisted relative to its relaxed, unfastened position. Also, the inclined sides of some of the tapered elements are frictionally adhered to at least some of the inclined sides of the other of the tapered elements to maintain the sheets fastened together. The force used to engage the fasteners on the two articles determines the force required to disengage the fasteners.

SUMMARY OF THE INVENTION

An article includes a mating surface fastener portion attached to a surface. The mating surface fastener portion has a land and a plurality of tapered elements and is capable of reattachably and matingly intermeshing with a fastener portion of another article to fasten the respective articles. The fastener portions have a predetermined disengagement pressure for a given engagement pressure. The surface to which the land is attached is at least semi-rigid.

The means for attaching has a compliance that is no greater than 0.381 cm. Also, the fastener portions can have a predetermined disengagement pressure for a given engagement pressure; for an engagement pressure of no more than 689,500 N/m$^2$ the fastener portion has a disengagement pressure of at least 137,900 N/m$^2$.

The means for attaching can be integrally molding the fastener portion together with the surface or using adhesive or other material.

The fastener portion can be formed with a first material. Either the first material, a second material, or both can be used to form the surface.

The invention is also a method of making an article. The method includes the step of selecting, in combination with each other, a mating surface fastener portion having a land and a plurality of tapered elements; a surface to which the land is attached; and an adhesive which attaches the land to the surface and has a predetermined compliance.

The land is adhered to the surface using the adhesive or the land is integrally molded to the surface.

DETAILED DESCRIPTION

Figure 2:
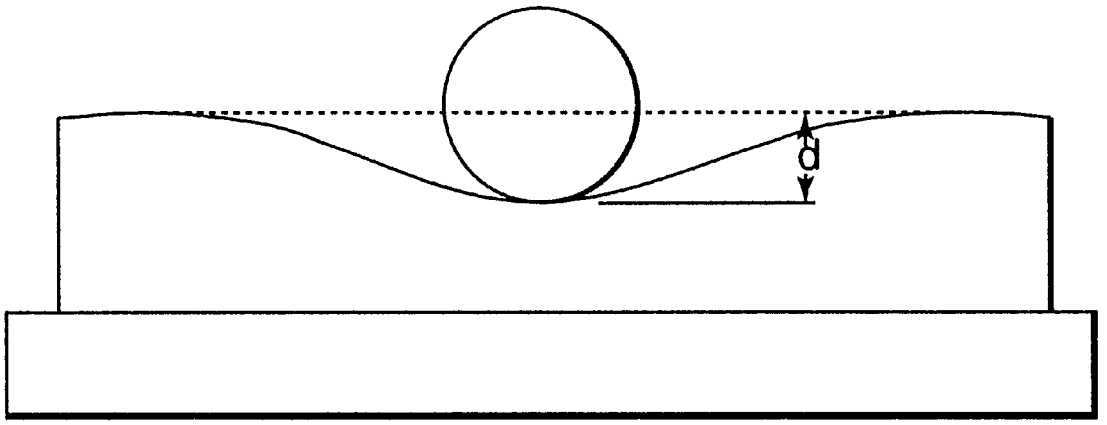
FIG. 2 is a cross-sectional view of a compliance test.

The inventors discovered that one of the significant features affecting the performance of mating surface fasteners is substrate compliance. Compliance (or flexibility) is the ease with which the substrate can comply with the forces to which it is subjected. A simple measurement of compliance is one in which a ball of a specific weight and size (or a ball with an additional weight) is placed on individual or combined layers to determine the deflection, d, of the surface from its undisturbed level. The higher the deflection of the surface, the higher the effective compliance. This is shown in FIG. 2. Compliance can depend on the thickness of the material. To measure compliance for this invention, the diameter of the ball was 1.112 cm (0.438 in) and had a mass of 5.59 g. An additional mass of 928.3 g was placed on the ball to produce the final displacement, d. Because the displacement increases with time and approaches a relaxed limit over a very long period of time, a time of 5 minutes after the weight was placed on the surface was selected to determine the displacement, d.

In determining the compliance of a fastener, three components of the system can be considered: the land (or base) of the fastener, the surface on which the fastener is attached, and the adhesive or other system used to attach the land to the surface. The effective compliance of this system is the combined effect of the compliance of each of these individual layers. In the examples in this specification, only the compliance of the adhesive was varied.

The inventors found that the higher the effective compliance, the lower the performance of the fastener. The reason for this behavior is that for effective fastening, the fastener posts should maintain their deformations and maintain the contact pressure among themselves necessary for friction. As the system becomes more compliant, the posts are more able to deform and release from each other. Thus, lowering the overall effective compliance desirably increases the necessary disengagement pressure for a given engagement pressure.

The inventors have also found that decreasing the compliance of any single component (land, surface, or adhesive) increases the performance, effectiveness, or strength of the fastener by improving the adhesion between adjacent posts. Some standard procedures for describing the performance include tensile, shear, and peel strengths. The tensile test measures the response of the fastener to substrate compliance. The test is performed by attaching 6.45 $cm^2$ (1 $in^2$) of fastener to two T-blocks using an adhesive. The T-blocks are then engaged using a prescribed engagement pressure $P_P$ (the force used to engage the T-blocks divided by the fastener portion area $A_F$), for example, by contact with the surface of a pneumatically- or hydraulically-urged piston of known surface area $A_P$, providing prescribed pressure $P_P$. The engagement pressure ($P_F$) on the fastener portion area $A_F$ is then calculated from the well-known, general relation $P_F/P_P=A_P/A_F$, for which $P_F=P_PA_P$. In this case $A_F=6.45$ $cm_2$ (1 $in^2$). To test this invention, the engaged T-blocks were mounted on a Chatillon TCD-200 Tension/Compression Tester made by John Chatillon & Sons, Inc. (Greensboro N.C., USA). Similar apparatus also can be used. The T-blocks were separated at a constant speed of 30.5 cm/min (12 in/min). The force required to disengage the T-blocks is used to calculate the disengagement pressure as a function of the engagement pressure. The maximum disengagement pressure is defined as the tensile strength of the fastener.

Mating surface fasteners of the invention connect materials and articles using intermeshing flexible tapered elements which can be microstructured. These elements can be conical or have planar sides. The posts can be tapered and can be a full or truncated pyramid with any number of sides. The posts can be elongated or can be regular pyramids. The fasteners can be used to fasten and hold rigid and semi-rigid objects together such as sheets of glass, metal, or plastic, as well as molded parts such as video screens covers, and telephone or pager components. The fastener components must conform to a range of physical properties to avoid post collapse during engagement.

When intermeshable inclined fasteners like those of U.S. Pat. Nos. 4,875,259 and 5,201,101 are mounted to rigid or semi-rigid objects by integral molding or thin, high-strength, non-compliant bonding materials, very high strength re-attachable fastening is accomplished. This bonding can be increased to keep the local stiffness of the fastener high to further improve bonding strength of the fastener. Thin, high-strength bonding material like high strength pressure sensitive adhesives (PSAs) can be used. Alternatively, the fastener can be directly bonded to the surface using direct molding such as compression molding, injection molding, and other methods. When the modulus of the intermeshable elements is controlled, intermeshing and bonding are further improved. Tensile strengths of over 689,500 $N/m^2$ (100 psi) have been achieved.

Figure 3:
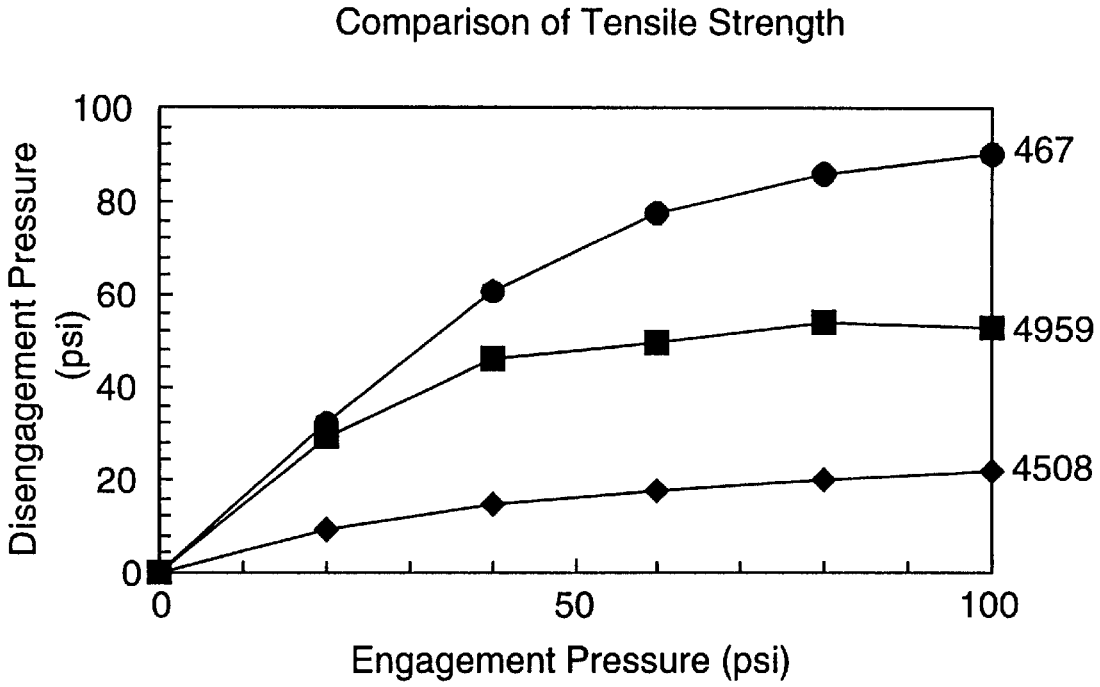
FIG. 3 is a graph comparing the performance of several adhesives of differing compliance.

FIG. 3 compares the effect of adhesive rigidity in a tensile test using a fastener with different adhesives. The fastening material used had tapered elements that were 0.0635 cm (0.025 in) high and is made by the Minnesota Mining and Manufacturing Company (St. Paul, Minn., USA). It was composed of a PVC from Shin-Etsu made by Shin-Etsu Polymer Co., Ltd. (Saitama Japan) for low plasticizer migration. The samples were mounted to T-blocks. One sample used 3M Scotch Foam 4508 tape. Another sample used a double coated acrylic foam tape 4959. The third sample used a stiffer 467MP Hi Performance Adhesive. All of the tapes and adhesives are made by the Minnesota Mining and Manufacturing Company.

As measured using the test of FIG. 2, the 467MP adhesive has a compliance of 0.00127 cm (0.0005 in), the 4959 adhesive has a compliance of 0.135 cm (0.053 in) and the 3M Scotch Foam 4508 tape has a compliance of 0.2652 cm (0.1044 in). As the graph of FIG. 3 illustrates, the adhesives with lower compliance have a higher tensile strength; the disengagement pressure for a given engagement pressure is higher. The increase in stiffness (decrease in compliance), from the least compliant (most stiff) to the most compliant (least stiff) fastener, increased the tensile performance by approximately 400%. Components fastened with higher tensile strength materials will be more difficult to separate.

From the graph, it can be seen that adhesives and other attaching devices that have a compliance of no more than 0.2652 cm (0.1044 in) can attain disengagement pressures of at least 137,900 $N/m^2$ (20 psi). For a given fastener, selecting the attaching device for low compliance can permit the fastener to require higher disengagement pressures than with an attaching device having a higher compliance. The inventors believe that attaching devices having a compliance of no more than 0.381 cm (0.15 in) can perform well. As seen in the graph, the inventors have also found that by choosing an attaching device with a suitable compliance, for a given engagement pressure, a desired disengagement pressure can be required. For example, the fastener portions can have a predetermined disengagement pressure of at least 68,950 $N/m^2$ for a given engagement pressure. In one embodiment, for an engagement pressure of no more than 689,500 $N/m^2$ (100 psi), a disengagement pressure of at least 137,900 $N/m^2$ (20 psi) is required.

By constraining the interface by using a rigid substrate, and limiting the interface locally by using a stiffer adhesive, the performance of the fastener can be improved further. Further increasing the local stiffness of the fastener using a higher adhesive modulus or reduced adhesive thickness, further improves fastening performance.

Figure 1:
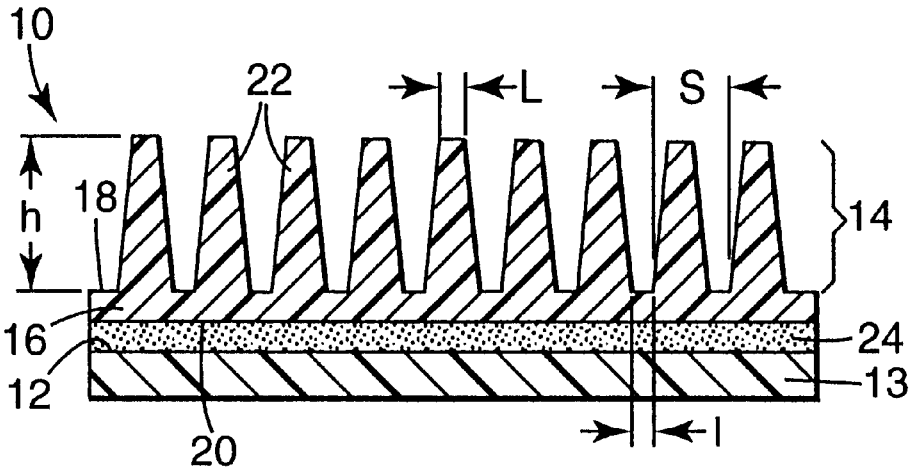
FIG. 1 is a cross-sectional view of an article of the present invention.

Referring to FIG. 1, the article 10 can be any article having any shape or size and having a surface 12 on an outer portion 13. The article 10 can be joined to any other article. Two articles to be joined can be the same or different articles. Each article 10 has a surface 12 to which a mating surface fastener 14 can be connected. The mating surface fastener 14 includes a land 16 having a first surface 18 and a second surface 20. A plurality of tapered elements 22 is connected to the first surface 18. Generally the tapered elements 22 can be formed integrally (such as by molding or other methods) with the land 16 and can be formed of the same or different materials than the land.

As shown, the first surface 18 and the tapered elements 22 create a structured surface. The tapered elements 22 can be posts which have at least one side inclined relative to the plane of the first surface 18 to form the taper. The angle of the taper is selected to be sufficient to permit each post to mesh with at least one corresponding post on another article. FIG. 1 shows what is called a 25 mil fastener. In this fastener, each element 22 has a height h of 0.0635 cm (0.025 in). The length L of each side of the top of the element 22 is 0.01209 cm (0.00476 in) and the length 1 of the distance between adjacent elements 22 measured at their base is 0.0104 cm (0.0041 in) The spacing s from element to element is 0.03360 cm (0.01323 in).

Figure 4:
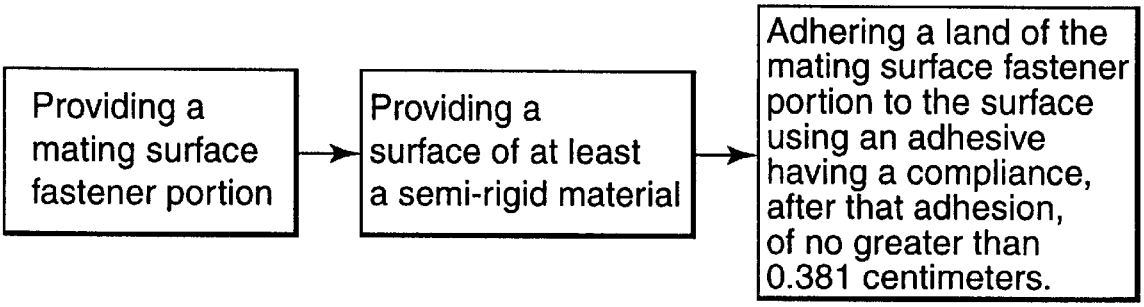
FIG. 4 is a diagram of a first method according to the present invention.

The fastener 14 can be connected to the surface 12 by any known method or attaching device. As shown in FIG. 1, some type of attaching device, shown as adhesive 24, whether in tape or other form, can be used (see FIG. 4 of the drawing).

Figure 5:
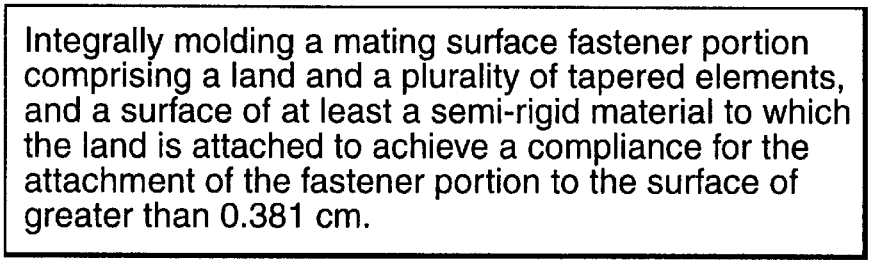
FIG. 5 is a diagram of a second method according to the present invention.

In another embodiment, the fastener 14 is connected to the surface 12 by molding the two components together (see FIG. 5 of the drawing). This can be accomplished without adding any thickness to the wall of the article. Any type of molding including injection molding, compression molding, slide molding, insert molding, and blow molding can be used. The material for the fastener 14 can be the same as the material used for the surface 12, can be different from that material, or can be a combination of materials.

To integrate a mating surface fastener structure onto a plastic article by injection molding, the fastener structure is generated on one or more surfaces of the plastic article during the same injection molding cycle as when the article is made. The details necessary to generate this fastening structure is incorporated into the mold.

In one embodiment, two molds were used. Both molds were a two-plate, single cavity construction. They were gated at one end with a conventional cold runner and tab gate. A nickel stamper with the fastener detail on the cavity side was inserted into the ejector side of the mold. Eight ejector pins ran through the stamper base to the cavity surface.

The first mold had a 2.54 cm (1.0 in) by 5.08 cm (2.0 in) by 0.152 cm (0.060 in) thick rectangular cavity. This created small plastic test coupons that had the fasteners integrated onto one surface. The second mold combined an existing mold for a 7.62 cm (3 in) by 3.81 cm (1.5 in) by 1.905 cm (0.75 in) hollow plastic box, with 0.1588 cm (0.0625 in) wall thickness, and a 25 mil (0.0635 cm) mating surface fastener nickel stamper insert. This created plastic boxes with the fastener structure integrated onto one of the surfaces. A 50 Ton all electric Cincinnati injection molding machine was used.

A hard (rigid) ABS plastic and a compliant material (Dow Devail 3050 made by Dow Chemical Company of Wilmington Del., USA) were molded. The injection molding process was similar to any injection molding process. Temperatures, cycle times, pressures, and other process variables were adjusted to obtain satisfactory results. None of these conditions deviated from what would be considered to be normal injection molding process conditions. The table provides data for some of the materials used. A full taper nozzle was used for all tests.

| | ABS | Dow Pelletane 2103 |
|---|---|---|
| Cycle Time (sec) | 60 | 75 |
| Mold Temp. (° F.) | 180 | 50 |
| Melt Temp. (° F.) | 444 | 415 |
| Injection high pressure (psi) | 1,000 | 700 |
| Pack Pressure (psi) | 300 | 249 |
| Extruder Speed (rpm) | 100 | 100 |
| Injection Speed (in/sec) | 5.0 | 5.0 |
| Shot size (in) | 0.86 | 0.56 |
| Nozzle orifice (in) | 0.12 | 0.12 |

Part ejection was a significant challenge for the microstructured fastener surfaces. Inserting the stamper into the ejector side of the mold, with eight ejector pins running through the stamper base to the cavity surface was key to effective ejection of the molded parts. The molds were designed to allow the use of high injection pressure to fill the stamper fastener detail, and still eject the part from the mold. It is important to optimize the mold parameters and variables in conjunction with the properties of the properties of the plastic or other material being molded. Material swell and shrinkage properties are of particular concern.

Another sample was prepared for compression molding by sequentially stacking a cardboard sheet, a chrome plated brass plate, a 12.7 cm by 12.7 cm (5 in by 5 in) nickel mating surface fastener tool with 0.0635 cm (0.025 in) cavities, shims adjacent to the tool which extend above the top of the tool to produce a product with a uniform land (base) thickness of about 0.025 cm (0.010 in), single layer of pelletized plasticized PVC (AlphaGary 2215-80) from AlphaGary Corp. (Leominister, Mass., USA), a second chrome plated brass plate, and a second cardboard sheet. The stack was placed in a compression molder (Wabash Model V75H-24-CLX from Wabash MPI, Wabash, Ind., USA) which was at 170° C. and pressed at 22,241 N (5000 lb) of load for 2 minutes. The load was increased to 88,964 N (20,000 lb) for an additional 2 minutes followed by cooling to approximately 80° C. under pressure. The stack was removed from the molder and disassembled to provide a functional fastener. As can be seen by comparing the dimensions of the mold cavity and the dimensions of the fastener portion, the fastener tapered elements 22 and the structured surface of the fastener as a whole are orders of magnitude smaller than the other features of the mold cavity.

The article 10 as a whole, and particularly the portion of the article that forms the structured surface, is at least semi-rigid. At least semi-rigid means the article can also be rigid. Articles having a surface 12 formed of glass, plastics, wood, metals, silicon, ceramics, and the like can be used. Many plastics can be used including ABS plastic, Dow Devail 3050 and Dow Pelletane 2103 (both made by Dow Chemical Company). [An article is at least semi-rigid if it deflects no more than 4 cm in the following test. Apply a 189.5 g mass to the center of a 15 cm by 25 cm sample of material to be tested. The material is supported by 1.4 cm rods spaced 15 cm apart. The deflection out of the plane is measured at the center of the sample. Preferred materials deflect no more than 2–3 cm. White packaging cardboard (0.58 mm thick) had a deflection of 0.8 cm. Brown packaging cardboard (0.82 mm thick) had a deflection of 0.35 cm. Corrugated cardboard (6.6 mm thick) had a deflection of 0.0 cm.

When two articles 10 are brought into contact with each other, the respective posts at least partially adhere to each other due to the frictional force of adherence of the contacting surfaces of the posts. This is accomplished without requiring macro-deformation, mechanical interference, or interlocking of the posts. (Deformation of surface irregularities and random micro asperities on a microscopic scale contribute to adherence by increasing the amount of actual area contact between the surfaces.) This adhesion of the posts intermeshably connects the two articles. It connects them reattachably (or refastenably).

Various changes and modifications can be made in the invention without departing from the scope or spirit of the invention. The disclosures of all patents mentioned are incorporated by reference.

What is claimed is:

1. An article comprising:

a first mating surface fastener portion comprising a land and a plurality of tapered elements, wherein the tapered elements have a free end and a base and wherein the taper of the elements extends for most of the length of the elements such that the free end is narrower than the base and the free end is the narrowest part of the tapered element, wherein the fastener portion is capable of reattachably and matingly intermeshing with a second mating surface fastener portion of a second article to fasten the respective articles, wherein the fastener portions, having been intermeshed, have a predetermined disengagement pressure for a given engagement pressure;

a surface to which the land is attached, wherein the surface is at least semi-rigid; and means for attaching the land to the surface, wherein the means for attaching has a compliance that is no greater than 0.381 cm.

2. The article of claim 1 wherein the means for attaching comprises integrally molding the first matins surface fastener portion together with the surface.

3. The article of claim 2 comprising a first material used to form the first mating surface fastener portion and at least one of the first material and a second material used to form the surface.

4. The article of claim 1 wherein the means for attaching comprises an adhesive layer.

5. The article of claim 1 comprising a first material used to form the first matins surface fastener portion and at least one of the first material and a second material used to form the surface.

6. The article of claim 1 comprising a first material used to form the tapered elements of the first matins surface fastener portion and at least one of the first material and a second material used to form the land of the fastener portion.

7. An article comprising:

a first mating surface fastener portion comprising a land and a plurality of tapered elements, wherein the tapered elements have a free end and a base and wherein the taper of the elements extends for most of the length of the elements such that the free end is narrower than the base and the free end is the narrowest part of the tapered element, wherein the first mating surface fastener portion is capable of reattachably and matingly intermeshing with a second similarly shaped mating surface fastener portion of a second article to fasten the respective articles, wherein the fastener portions, having been intermeshed, have a predetermined disengagement pressure of at least 78,400 $N/m^2$ for a given engagement pressure;

a surface to which the land is attached, wherein the surface is at least semi-rigid; and means for attaching the land to the surface, wherein the compliance of the means for attaching is no greater than 0.381 cm.

8. The article of claim 7 wherein the mating surface fastener portions have a predetermined disengagement pressure of at least 137,900 $N/m^2$ for a given engagement pressure.

9. The article of claim 8 wherein for an engagement pressure of no more than 689,500 $N/m^2$ the first mating surface fastener portion has a disengagement pressure of at least 137,900 $N/m^2$.

10. The article of claim 7 wherein the means for attaching comprises integrally molding the first mating surface fastener portion together with the surface.

11. The article of claim 10 comprising a first material used to form the first mating surface fastener portion and at least one of the first material and a second material used to form the surface.

12. The article of claim 7 wherein the means for attaching comprises an adhesive layer.

13. The article of claim 7 comprising a first material used to form the first mating surface fastener portion and at least one of the first material and a second material used to form the surface.

14. The article of claim 7 comprising a first material used to form the tapered elements of the first mating surface fastener portion and at least one of the first material and a second material used to form the land of the first mating surface fastener portion.

15. A method of making an article comprising:

providing a mating surface fastener portion comprising a land and a plurality of tapered elements, wherein the tapered elements have a free end and a base and wherein the taper of the elements extends for most of the length of the elements such that the free end is narrower than the base and the free end is the narrowest part of the tapered element;

providing a surface of at least a semi-rigid material to which the land is to be attached; and adhering the land to the surface using an adhesive having a compliance of no greater than 0.381 centimeters, thereby to achieve a predetermined disengagement pressure for a given engagement pressure.

16. A method of making an article comprising molding, integrally and as one piece, a mating surface fastener portion comprising a land and a plurality of tapered elements, and a surface of at least a semi-rigid material to which the land is attached to achieve a compliance for the attachment of the matins surface fastener portion to the surface of no greater than 0.381 cm, and to achieve a predetermined disengagement pressure for a given engagement pressure.

17. The method of claim 16 wherein the molding step comprises at least one of injection molding, compression molding, insert molding, slide molding, and blow molding.

* * * * *

UNITED STATES PATENT AND TRADEMARK OFFICE

CERTIFICATE OF CORRECTION

PATENT NO. : 6,223,401 B1
DATED : May 1, 2001
INVENTOR(S) : Joseph M. D'Sa, Paul E. Humpal, Raymond P. Johnston and Vincent W. King It is certified that error appears in the above-identified patent and that said Letters Patent is hereby corrected as shown below:

Column 7,
Line 27, "matins" should read -- mating --;
Line 31, "matins" should read -- mating --;

Column 8,
Line 47, "matins" should read -- mating --.

Signed and Sealed this

Sixteenth Day of April, 2002

*Attest:*

*Attesting Officer*

JAMES E. ROGAN
*Director of the United States Patent and Trademark Office*